US006296581B1

(12) United States Patent
Sever

(10) Patent No.: US 6,296,581 B1
(45) **Date of Patent: *Oct. 2, 2001**

(54) COLLAPSIBLE BATTING PRACTICE APPARATUS, AND CONNECTABLE PLASTIC TUBING USED IN SAME

(76) Inventor: Terry L. Sever, 34436 Beechwood Dr., Farmington Hills, MI (US) 48835

( * ) Notice: Subject to any disclaimer, the term of this patent is extended or adjusted under 35 U.S.C. 154(b) by 0 days.

This patent is subject to a terminal disclaimer.

(21) Appl. No.: 08/382,486

(22) Filed: Feb. 1, 1995

(51) Int. Cl.[7] ..... A63B 69/00
(52) U.S. Cl. ..... 473/422; 473/415
(58) Field of Search ..... 273/26 R, 26 D, 273/201, 29 A, 29 R, 411, 407, 408, 409, 410, 412; 403/289, 313; 414/382; 285/15; 206/315.6; 473/137

(56) References Cited

U.S. PATENT DOCUMENTS

| | | | | |
|---|---|---|---|---|
| 1,348,434 | * | 8/1920 | Marshick | 403/289 |
| 2,609,638 | * | 9/1952 | Lindenmeyer | 403/289 |
| 2,827,297 | * | 3/1958 | Foster | 273/407 |
| 2,955,823 | * | 10/1960 | Chanko | 273/26 D |
| 3,231,278 | * | 1/1966 | Boulanger | 273/411 |
| 3,716,234 | * | 2/1973 | Lancedotti | 206/315.1 |
| 3,952,477 | * | 4/1976 | Candor | 273/26 R |
| 4,132,214 | * | 1/1979 | Schnurr | 273/26 D |
| 4,151,996 | * | 5/1979 | Lee | 273/407 |
| 4,478,434 | * | 10/1984 | Little | 285/15 |
| 4,673,010 | * | 6/1987 | Prufer et al. | 141/382 |
| 4,948,149 | * | 8/1990 | Lin | 273/411 |
| 4,955,606 | * | 9/1990 | Leps | 273/26 D |
| 4,979,754 | * | 12/1990 | Eisenhart | 273/411 |
| 5,042,802 | * | 8/1991 | Depianta | 273/26 D |
| 5,066,010 | | 11/1991 | Pingston . | |
| 5,097,985 | | 3/1992 | Jones . | |
| 5,232,218 | | 8/1993 | Leps . | |
| 5,292,119 | | 3/1994 | Norcross . | |
| 5,294,109 | * | 3/1994 | Meade | 273/26 D |
| 5,335,905 | * | 8/1994 | Newgarden | 273/30 |
| 5,346,222 | * | 9/1994 | Luther | 273/201 |
| 5,421,313 | * | 6/1995 | Strayer | 273/26 D |

* cited by examiner

*Primary Examiner*—Jeanette Chapman
*Assistant Examiner*—Alvin A. Hunter, Jr.
(74) *Attorney, Agent, or Firm*—Carrier, Blackman & Associates, P.C.; Joseph P. Carrier; William D. Blackman

(57) ABSTRACT

According to the invention there is disclosed a collapsible batting practice apparatus which comprises an inclined ball delivery channel for delivering a ball to a hitting area under gravitational forces, a support stand for supporting the inclined ball delivery channel at an elevated position, the support stand including a base and an elongate column connecting the inclined ball delivery channel and the base, and the inclined ball delivery channel and the elongate column being selectively collapsible into sections storable within the base. The base preferable comprises a five to seven gallon bucket, the elongate column is formed from a plurality of rigid tubular sections formed of a rigid plastic such as polyvinyl chloride and compressible rigid connectors also formed of PVC or the like which fit within the sections of tubing so as to be completely concealed thereby. Additionally, the apparatus also preferably includes a batting practice net for restricting movements of batted balls, a collapsible support frame for supporting the net in a substantially vertical orientation, and a base which dually functions to support the collapsible frame in an operative position thereof and to store the components of the collapsible frame and the net when disassembled.

1 Claim, 2 Drawing Sheets

FIG. 1
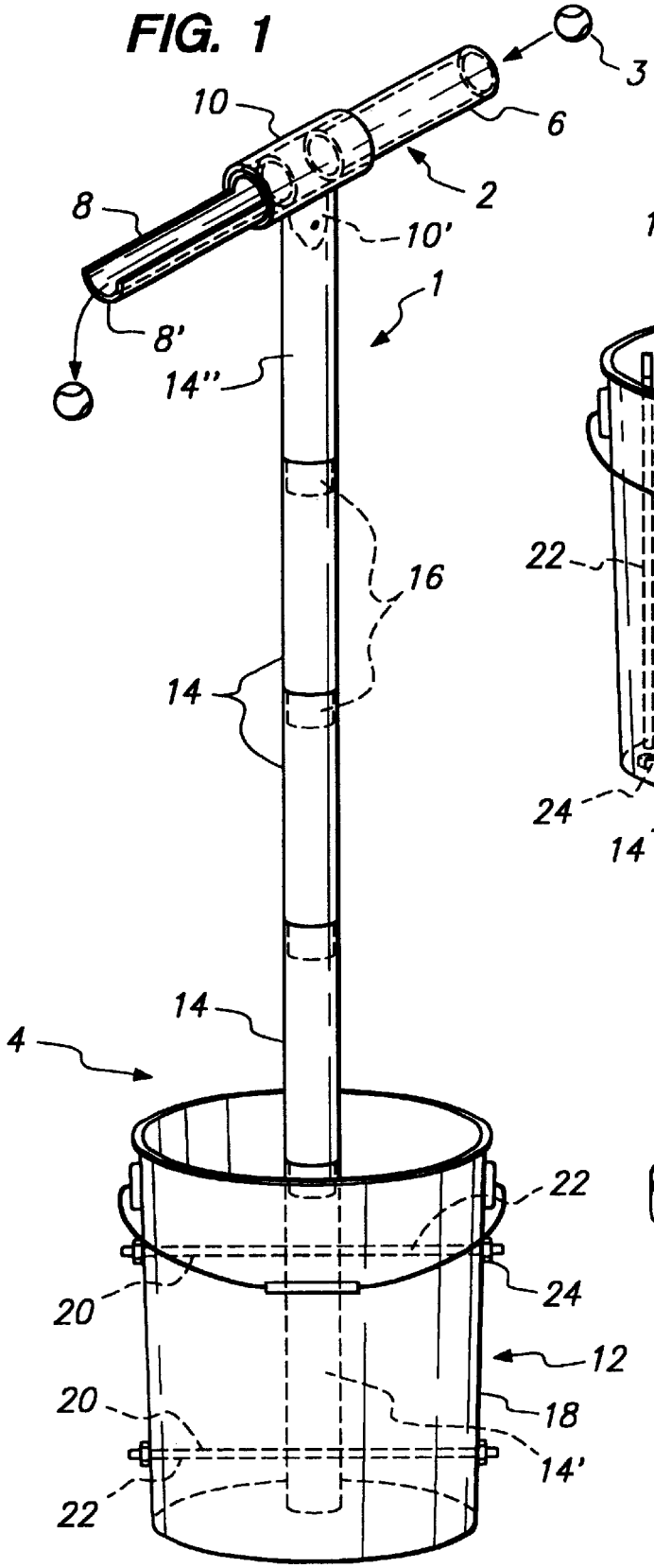
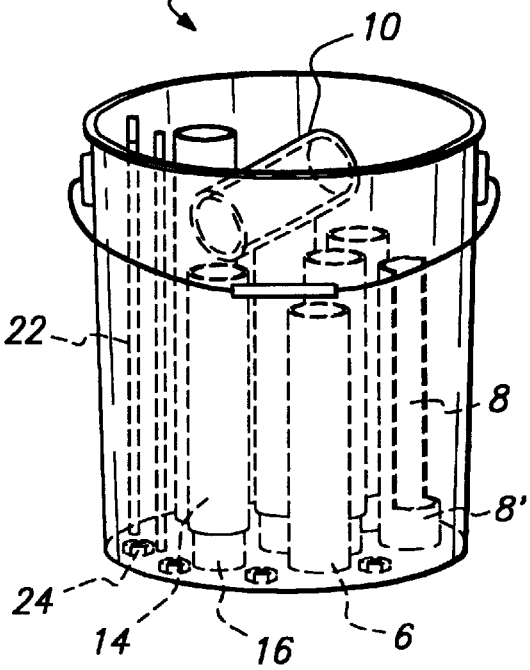
FIG. 2
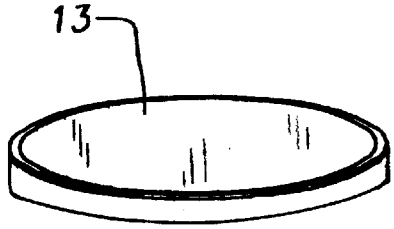
FIG. 2a

COLLAPSIBLE BATTING PRACTICE APPARATUS, AND CONNECTABLE PLASTIC TUBING USED IN SAME

BACKGROUND OF THE INVENTION

1. Field Of The Invention

The present invention pertains to a collapsible batting practice apparatus, and to a plastic tubing structure for use in same. More particularly, the invention pertains to such a batting practice device which is adjustable in multiple dimensions so that it may be effectively used by anyone, and to a collapsible plastic tubing structure which is easy and economical to produce, and yet results in the batting practice device being very durable and rigid.

2. Description Of Relevant Art

There are many known batting practice devices. For example, U.S. Pat. Nos. 4,955,606; 5,042,802; 5,066,010; 5,097,985; 5,232,218 and 5,292,119 each disclose a type of batting practice device in which balls are delivered one-by-one along an inclined channel to a batting area where the balls are dropped or "soft tossed" from the delivery channel so that a batter may swing at the balls. Although all of such known batting practice devices are effective for their intended purpose, they all have disadvantages and limitations associated therewith, whereby they do not sufficiently challenge a hitter to improve his or her swing to a high skill level, and whereby they are excessively cumbersome and expensive, liable to breakage, and difficult to adjust. For example, each of the devices disclosed in the discussed patents includes some type of ball delivery mechanism which must be actuated to initiate the delivery of a ball along the delivery channel, including an electric motor disclosed in U.S. Pat. No. 5,097,985, foot-actuated switches disclosed in U.S. Pat. Nos. 5,066,010 and 5,292,119, a hand-activated lever disclosed in U.S. Pat. No. 5,042,862, and bat-actuated mechanisms disclosed in U.S. Pat. Nos. 4,955,606 and 5,232,218. As will be understood, each of these mechanisms adds a significant cost to the practice device, and also may become broken or damaged with use, rendering the overall device less reliable.

Further, each of the disclosed devices permits only a limited amount of adjustment, primarily adjustment of the height at which the ball is delivered to a batting area, so that the device becomes non-challenging once the basic ball delivery pattern is mastered by a batter.

Still further, although the known batting practice devices may be collapsed or disassembled to some extent, each remains somewhat bulky, cumbersome, and hence difficult to transport and store.

The present invention has been developed to overcome the disadvantages and limitations of known batting practice devices, including those discussed above, and to generally fulfill a need in the art for a batting practice device which is adjustable in multiple dimensions such that it is challenging for substantially anybody regardless of size or skill level, which is sturdy and reliable in structure, economical to produce, and easy to assemble, disassemble, store and transport.

SUMMARY OF THE INVENTION

According to the invention there is provided a batting practice apparatus comprising an inclined ball delivery means for delivering a ball to a hitting area;

support stand means for supporting the inclined ball delivery means at an elevated position, the support stand means including a base and an elongate column connecting said base and said inclined ball delivery means; and the inclined ball delivery means and the elongate column being selectively collapsible and storable within the base.

Preferably the ball delivery means includes a ball feed section, a ball output section disposed at a level lower than the ball feed section, and a curved intermediate section connecting the ball feed and ball output sections such that free ends of the ball feed and ball output sections face in substantially the same direction such that a batter may place a ball in the ball feed section and swing at a ball delivered from the ball output section while standing in the same location. Also preferably, the ball delivery means is substantially U-shaped when viewed in plan; at least one of the ball feed and ball output sections is rotatable relative to the intermediate section for adjusting an angular orientation thereof; and the ball delivery means includes a hollow tubular member and an open channel member, each of which is selectively attachable as part of either of the ball feed and ball output sections.

According to the invention there is also provided an interfitting tubing system which may be used in constructing the collapsible batting practice apparatus, the tubing system comprising: a plurality of rigid tubing sections and a plurality of connectors fittable within ends of the tubing sections for connecting the sections together in an end-to-end manner; each connector comprising plastic tubing having a nominal, uncompressed outside diameter slightly larger than an average inside diameter of the tubing sections and a narrow gap defined along a longitudinal length thereof such that the connector may be selectively compressed along the gap for reducing the nominal diameter thereof. Preferably the tubing sections and the connectors are formed of rigid plastic tubing such as polyvinyl chloride (PVC) tubing such as is conventionally utilized for plumbing applications; ends of the connectors will have beveled edges for facilitating insertion of the connectors into the tubing sections, and one end of each connector will be integrally fixed to one end of a column section for facilitating assembly of the sections and connectors together.

According to the invention there is additionally provided a collapsible support stand comprising base means for being disposed on a substantially flat surface; stand means, which connects to the base means, for defining an elevated support surface above the base means; the base means including a receptacle; and the stand means including a plurality of tubing sections and a plurality of connectors fittable within the tubing sections for joining the sections together in an end-to-end manner, the tubing sections and the connectors being selectively collapsible and storable within the receptacle.

It is an object of the invention to provide a collapsible batting practice apparatus which is readily adjustable in multiple dimensions so that it may be used in a challenging manner by substantially anyone regardless of size or skill level.

It is another object of the invention to provide such a batting practice device which is constructed of rigid, durable components such that it may be reliably used for a long period of time, and yet is simple and economic to manufacture.

It is a further object of the invention to provide such a batting practice apparatus which is constructed of a plurality of individual sections which may be readily assembled together into a sturdy structure, or disassembled into individual pieces for storage and transportation.

It is still another object of the invention to provide such a batting practice apparatus which integrally includes a storage and transportation receptacle.

Another object of the invention is to provide a novel connector structure for interconnecting sections of plastic tubing in a rigid manner.

It is yet another object of the invention to provide a collapsible, adjustable batting practice apparatus including both a means for delivering a ball to be hit and means for restricting movement of the ball after it is hit.

A still further object of the invention is to provide such a batting practice device which may be conveniently used by a single person.

Other objects, advantages and salient features of the invention will be apparent from the following detailed description which, when taken in conjunction with the annexed drawings, discloses preferred embodiments of the invention.

BRIEF DESCRIPTION OF THE DRAWINGS

FIG. 1 is a front elevational view of a preferred embodiment of the invention in an assembled state, with some internal structure of the apparatus detailed in broken lines.

FIG. 2 is a front elevational view of the embodiment of FIG. 1 in a disassembled state, again with some internal structure revealed in broken lines.

FIG. 2*a* is a top perspective view of a lid for the receptacle base of the embodiment shown in FIG. 1.

DETAILED DESCRIPTION OF THE PREFERRED EMBODIMENTS

Figure 4:
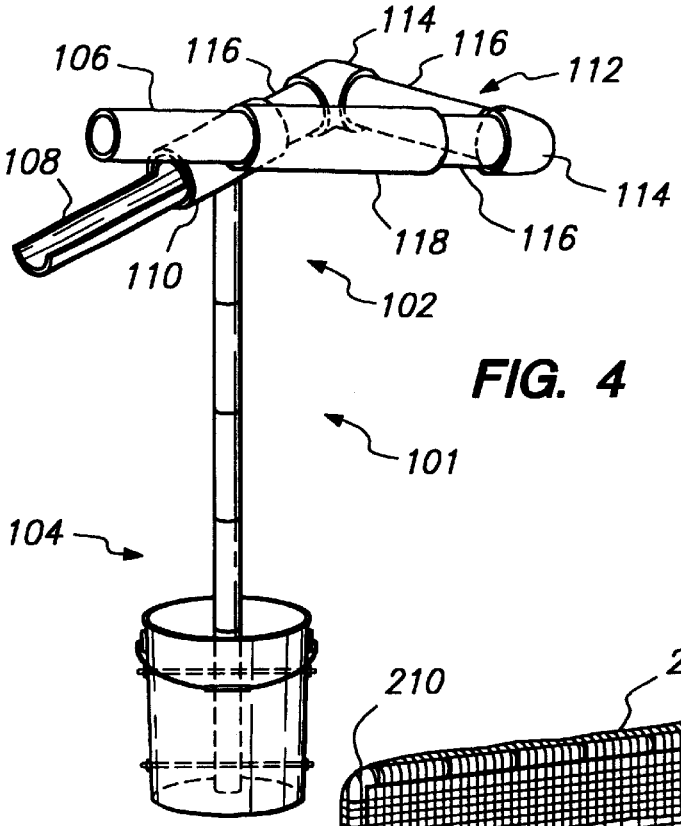
FIG. 4 is a front elevational view of a modification of the embodiment of FIG. 1.

Referring to FIGS. 1 and 2, there is shown a preferred embodiment of a batting practice device 1 according to a preferred embodiment of the invention. The batting apparatus 1 generally includes an inclined ball delivery means 2 and a support stand means 4. The ball delivery means 2 according to this embodiment includes three sections, a hollow tube section 6, an open channel section 8, and a connector section 10; while the support stand means 4 comprises a base means 12, a plurality of tubing sections 14, 14', 14", and a plurality of connectors 16 used in joining the sections 14, 14', 14" together. The base means 12 includes a receptacle 18 and means 20 for securing the lowermost tubing section 14' centrally within the receptacle. The several components may be assembled together with the tubing sections and the ball delivery means extending from and above the receptacle 18 as shown in FIG. 1 so that a ball 3 may be delivered through the delivery means 2, and may be disassembled and conveniently stored within the receptacle as shown in FIG. 2.

Preferably each of the components 6, 8, 10, 14, 14', 14", 16, 18 is formed of a rigid plastic material such as PVC tubing conventionally used in plumbing applications, polypropylene, polyethylene, polyethylene terephthalate, etc., while the receptacle 18 is preferably formed of polyethylene or other suitable plastics, and the securing means 20 preferably includes rods 22 with threaded ends and threaded nuts 24 which may be selectively fitted to the rods 22. The rods 22 extend through openings defined in the receptacle 18 and the lowermost tubing section 14'. A lid 13 is also provided for covering the open end of the receptacle 18 as shown in FIG. 2*a*.

Figure 3:
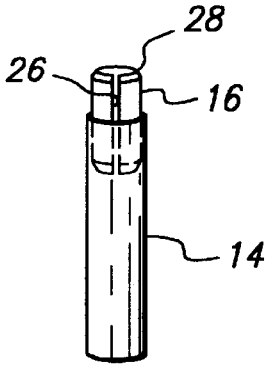
FIG. 3 is a front elevational view of one section of the embodiment shown in FIG. 1, with portions of a connector shown in dotted lines to reveal the structure thereof.

With reference to FIG. 3, the preferred structure of a connector 16 according to the invention is more particularly shown. The connector 16 preferably comprises a length of tubing formed of an appropriate plastic such as PVC as discussed above, with a nominal, uncompressed outside diameter slightly larger than the inside diameter of the tubing section 14, and a narrow gap 26 is defined in the connector fully along a longitudinal length thereof The gap 26 permits the connector 16 to be selectively compressed therealong for reducing the nominal diameter thereof, such that the connector may be fitted within the tubing sections 14. The gap 26 is sufficiently wide that when the connector 16 is fully compressed, i.e., such that the opposing faces of the connector 16 defining the gap are brought into engagement with each other, the nominal outside diameter of the connector is smaller than the inner diameter of the tubing section 14. Thus, the connector 16 may be easily fitted within a tubing section 14 by slightly compressing the connector along the gap 26, and once the end of the connector 16 is within the end of the tubing section 14 the connector's structural tendency to flex or spring back to its uncompressed state imposes an expansive force against the inner surface of the tubing section 14, stably locking the connector and tubing section in their engaging relationship. The expansive force is sufficiently great that the connector and tubing section will not separate under the force of gravity if one or more tubing section is suspended from a connector, although the tubing section and connector may be rotated relative to each other and tubing sections may be easily pulled apart by an individual.

To facilitate insertion of the connector 16 within a tubing section 14, end edges 28 of the connector are preferably beveled as shown, so that the connectors 16 are self-compressing through action of the beveled edge as they are slid into the tubing sections 14. Also preferably, one end of each connector 16 will be fixed within one end of a tubing section 14 using adhesive or the like, so that the assembly and disassembly of the apparatus is facilitated and so that the connectors will not be excessively inserted into a tubing section 14.

Although the tubing sections 14 and connectors 16 are preferably formed as separate components according to the invention, each of the sections 14, 14', 14" may be formed or molded integrally with one of the connectors 16 as a single member so that it would be unnecessary to fix one end of the connector 16 within one end of a tubing section 14. With such modification it is still preferred that the portion of the connector projecting from the tubing section have a narrow gap defined therein along its longitudinal length, a beveled outer edge, and a nominal, uncompressed outer diameter slightly larger than the inner diameter of the tubing section so that the projecting connector portion will securely engage a tubing section when it is compressively inserted therein.

The preferred structure of the connector 16 according to the invention is very advantageous for several reasons. For example, the disclosed structure provides a very rigid and stable connection even when several of the tubing sections 14, e.g., when 5–15 sections are joined together, the joined sections are nearly as sturdy as a single piece of tubing formed from the same material as the sections 14 and having the same length as the combined length of the joined sections; each connected pair of the sections 14 are rotatable relative to each other about the connector 16 for adjustment purposes; and the sections 14 may be readily disassembled for storage and transportation. Further, when a pair of the sections 14 are joined together by a connector, end edges of the sections are brought into direct engagement with each other so that the connector is completely concealed within the sections and the sections favorably appear to be a single length of tubing. Still further, plastic tubing such as PVC tubing is conventionally formed by extruding the plastic tubing with close manufacturing tolerances on the outer diameters of the tubing because conventional plastic tubing connectors are fitted and bonded to the outer surfaces of the plastic tubing. On the other hand, the inner diameter of conventional plastic tubing tends to vary somewhat from tubing section to tubing section because the inner diameter is not manufactured to any close tolerance. Despite such variation in the inner diameter of plastic tubing, however, the connector 16 according to the invention provides an excellent connection for the conventional tubing because the gap 26 in the connector is compressed to varying degrees to accommodate the discrepancies in the inner diameters of the tubing.

Referring again to FIG. 1, the connector section 10 of the inclined ball delivery means 2 is preferably joined to the upper tubing section 14" at an acute angle of approximately 40°–70°, such as being bonded together with adhesive or being molded integrally together as a single piece, while the hollow tubing and open channel sections 6, 8 are selectively fittable to the opposite ends of the connector section 10 as shown. Alternatively, the connector section may be pivotally connected to the upper end of tubing section 14", for example using a pivot bracket 10' such as shown in dotted lines in FIG. 1, which may be formed integrally with connector 10.

According to a preferred aspect of the invention, an end 8' of the open channel section 8 fittable within the connector section 10 has the same outside diameter as the ends of the hollow tubing section 6 so that the section 6, 8 may be interchangeably fitted to the opposite ends of the connector section 10. The interchangeable nature of the section 6, 8 with respect to the connector section 10 is desirable because it adds a dimension of adjustability to the batting practice device for adjusting the difficulty of using same. Particularly, when the open channel section 8 is connected to the lower end of the connector section 10 a batter can readily perceive and anticipate the ball approaching the free end of the section 8 before it drops, whereas if the hollow tubular section 6 is connected to the lower end of the connector section 10 the batter cannot perceive the ball much before it reaches the free end of the section 6, and thus will have to react with greater skill to hit the ball after it is dropped. This is especially so if the connector section 10 is rotated, together with tubing section 14", such that the free end of the tubing section 6 faces away from the batter and the batter cannot look into the section 6.

The end 8' of the open channel section 8 and one or both ends of the hollow tubular section 6 may be formed with an outer diameter which is slightly larger than the inner diameter of the ends of the connector section 10, and with a longitudinally extending gap similar to the gaps 26 formed in the connectors 16 so that the ends of the section 6, 8 may be compressively fitted within the open ends of the connector section 10 similar to the connectors 16 which compressively fit within the tubing sections 14 as shown in FIG. 3.

Although the preferred structure of the securing means 20 and the receptacle 18 are as shown in the drawings and discussed above, it will be understood that modifications may be made thereto. For example, the plastic tubing section 14' could be formed or molded integrally with the receptacle 18 as a unitary member, the lowermost tubing section 14' could be otherwise permanently fixed to the bottom surface of the receptacle 18 using adhesive, a connector 16 could be molded integrally with or otherwise fixed to the bottom surface of the receptacle 18 so that the lowermost tubing section 14' could be simply fitted thereover when the device is assembled, etc. With any of such modifications, however, it is preferred that some type of bracing be provided for stably securing the lowermost tubing section 14' at a central position in the receptacle 18 so that it may stably support the other portions of the support column and the ball delivery means.

Further, the ball delivery means 2 may be connected to the upper section of tubing 14" by a spring which extends within the tubing 14" and normally holds the ball delivery means 2 in engagement with the tubing 14". With such structure, the relative orientation of the open channel section 8 and the hollow tubular section at higher and lower levels, respectively, can be quickly reversed by simply lifting the ball delivery means from its engagement with the section 14" (against the force of the spring), rotating the ball delivery means 180°, and again returning it into engagement with the section 14". With such spring biased structure the connector section 10 may be omitted, and instead having the sections 6, 8 join directly together with one of the sections 6, 8 joined to the section 14".

With regard to the size of the batting practice apparatus 1, it is preferred that when fully assembled the apparatus will be approximately 1–3 meters tall (which height may be adjusted by adding and removing lengths of the tubing sections 14, 14', 14") from the bottom of the receptacle 18 to the upper end of the ball delivery means 2, ball delivery means will be approximately 0.5–1.2 meters long from tip to tip, the column will preferably include at least one of each of the tubing sections 14, 14', 14", although it is preferred there will be several of the tubing sections 14 so that the overall height of the apparatus may be easily adjusted by adding and removing the sections 14, there will preferably be tubing sections 14 of different lengths such as 15 cm, 30 cm, 45 cm, and the receptacle 18 will be of a standard size such as 5 or 7 gallons. Further, it is preferred that the tubing used in forming the sections 6, 8, 10, 14, 14', 14" and connectors 16 be formed of a rigid PVC such as conventionally used in plumbing applications, as discussed above, the conventional tubing having a wall thickness of approximately 2–5 millimeters. As shown in FIG. 1, tubing sections 6, 8, 10 are preferably of a larger diameter than the tubing sections 14, 14', 14", for example twice as large. In an exemplary device constructed by applicant, the sections 6, 8 are formed of PVC tubing having an o.d. of 83 mm (3.25 inches) PVC tubing, 30 cm long, the section 10 is formed of PVC tubing having an i.d. of 83 mm, and approximately 15 cm long, the tubing sections 14, 14', 14" are formed of PVC tubing having an i.d. of approximately 41 mm and a length of approximately 30 cm, the connectors 16 are formed of PVC having an o.d. of approximately 42 mm, are 8 cm long with a gap width of approximately 2.5 mm, and the receptacle 18 is a seven-gallon bucket formed of polyethylene. When assembled together with six lengths of tubing 14, 14', 14", the device is approximately 2 meters tall, and yet is very rigid and stable.

In another exemplary device constructed by applicant, a two-gallon bucket is used as the receptacle 18, and PVC tubing having approximately half the width as the tubing sections described in the first example above were used. The overall height of the device in the second example is approximately 1.5 meters, and again the fully assembled structure is very stable and rigid.

If desired, water, sand or other types of weighty filler may be placed in the receptacle 18 for giving the assembled device added stability, and if water is to be used for giving the device added stability, the openings through which the rods 22 project will be made leakproof by utilizing an appropriate packing or a gasket therein.

In use of the batting practice device the several components may be assembled from the completely disassembled state as shown in FIG. 2 to that shown in FIG. 1 in approximately five minutes or less. Further, the lowermost tubing section 14' may remain fixed to the receptacle 18 through the securing means 20 after it is assembled for the first time, in which case the entire device can be rapidly assembled in approximately 1–2 minutes. Such times also apply for disassembly of the device.

Dimensionally, the apparatus 1 may be adjusted in several ways. Height can be adjusted by adding and removing lengths of the tubing 14, 14', 14", and such height adjustment is desirable for several reasons. For example, height may be adjusted according to the size of the batter; for adjusting the difficulty of use, i.e., if the distance the ball drops to a hitting area is reduced the batter's reaction time is also reduced; to practice swinging at different types of pitches such as high inside pitches, low inside pitches, etc.

Further, the tubular section 6 may be connected to the lower end and section 8 to the upper end of connector section 10 for greater difficulty in use, or the opposite order for less difficulty as discussed above; the connector section 10 may be rotated to face the batter for less difficulty, or to face away from the batter for increased difficulty; the angle of inclination of the connector 10 relative to the uppermost tubular section 14" may be rotated to a greater pitch for increased difficulty or to a lesser pitch for reduced difficulty; etc.

Referring to FIG. 4, there is shown a modification of the embodiment in FIG. 1. Structurally, the modification is entirely in the ball delivery means 102, whereas the support stand means 104 is identical to the support stand means 4 of the first embodiment and will not be further discussed. The ball delivery means 102 according to the modified embodiment includes a connector section 110 connected to the uppermost tubular section of the support stand means 104, a hollow tubular section 106 and an open channel section 108 similar to the first embodiment, and also includes a curved intermediate portion 112. As depicted the curved intermediate portion 112 will preferably comprise a pair of 90° elbows 114, a plurality of straight connecting sections 116, and an extension section 118, all of which connect together with sections 106, 108, 110 such that the ball delivery means 102 is substantially U-shaped when viewed in plan, although it is inclined from one end (the free end of section 106) to the other end (the free end of section 108). With such a structure, the free ends of the sections 106, 108 face in substantially the same direction such that a batter may place a ball in the free end of section 106, pick up his or her bat, and swing at the ball after it travels through the ball delivery means and drops from the free end of section 108. Such arrangement is very advantageous because a batter may conveniently practice using the device by himself or herself, whereas with the embodiment of FIG. 1 it would be practically necessary to have another person place the balls in the free end of section 6.

According to this modification, the components 106, 108, 110, 114, 116, 118 are again preferably constructed of a rigid plastic material such as PVC tubing; and the sections 106, 108 may be interchangeably connected to the connector 110 and to the end of the extension 116. Further, the components 106, 108, 110 preferably have the identical structure as those of the components 6, 8, 10 in the first embodiment, while the straight pieces 116 will preferably have an outside diameter slightly larger than the inside diameters of connector 110, elbows 114 and extension section 118, while gaps will be defined longitudinally along end portions of the pieces 116 so that they may be compressively fitted within ends of the connector 110, elbows 114 and section 118 similar to the structure discussed above in relation to FIG. 3. Alternatively, the straight pieces 116 may be formed as small connectors which are disposed entirely within the connector 110, elbows 114 and section 118 similar to the connectors 16 which are disposed entirely within tubing sections 14, 14', 14" according to the first embodiment as discussed above. Advantageously, the elbows 114 are rotatable about straight pieces 116 so that the relative degrees of inclination of the extension section 118 and of the piece 116 between the elbows may be adjusted to have a greater or lesser pitch, for thereby adjusting the speed at which the ball is delivered through the ball delivery means. Alternatively, intermediate portion 112 could be formed with fewer sections than that depicted in FIG. 4. For example, the connector section 110 could be formed integrally with one of the elbows 114, the extension section 118 could be formed integrally,with the other elbow 114, and such two modified sections could be joined together by a single straight piece 116, which could be disposed entirely within the two modified sections. With such alternative structure, the two modified sections would still be rotatable relative to each other about a straight piece 116 between same. As another alternative, the entire intermediate section 112 could be formed as a unitary member, although this is less preferred because such a unitary member would be relatively large and difficult to fit within the receptacle of the base means 104, and because such a unitary piece would not be rotatable relative to itself for adjusting the pitch of the ball delivery means.

Dimensionally, the ball delivery means 102 according to the modified embodiment is preferably 0.6–1.2 meters feet long from the tip of section 106 or 108 to the rear face of the intermediate section 112, and approximately 25–60 cm wide from elbow 114 to elbow 114. An exemplary model of the apparatus constructed by applicant having such a ball delivery means 102, and a support shaft means including a seven-gallon receptacle and a 2 meter high vertical support column was very rigid and stable.

Figure 5:
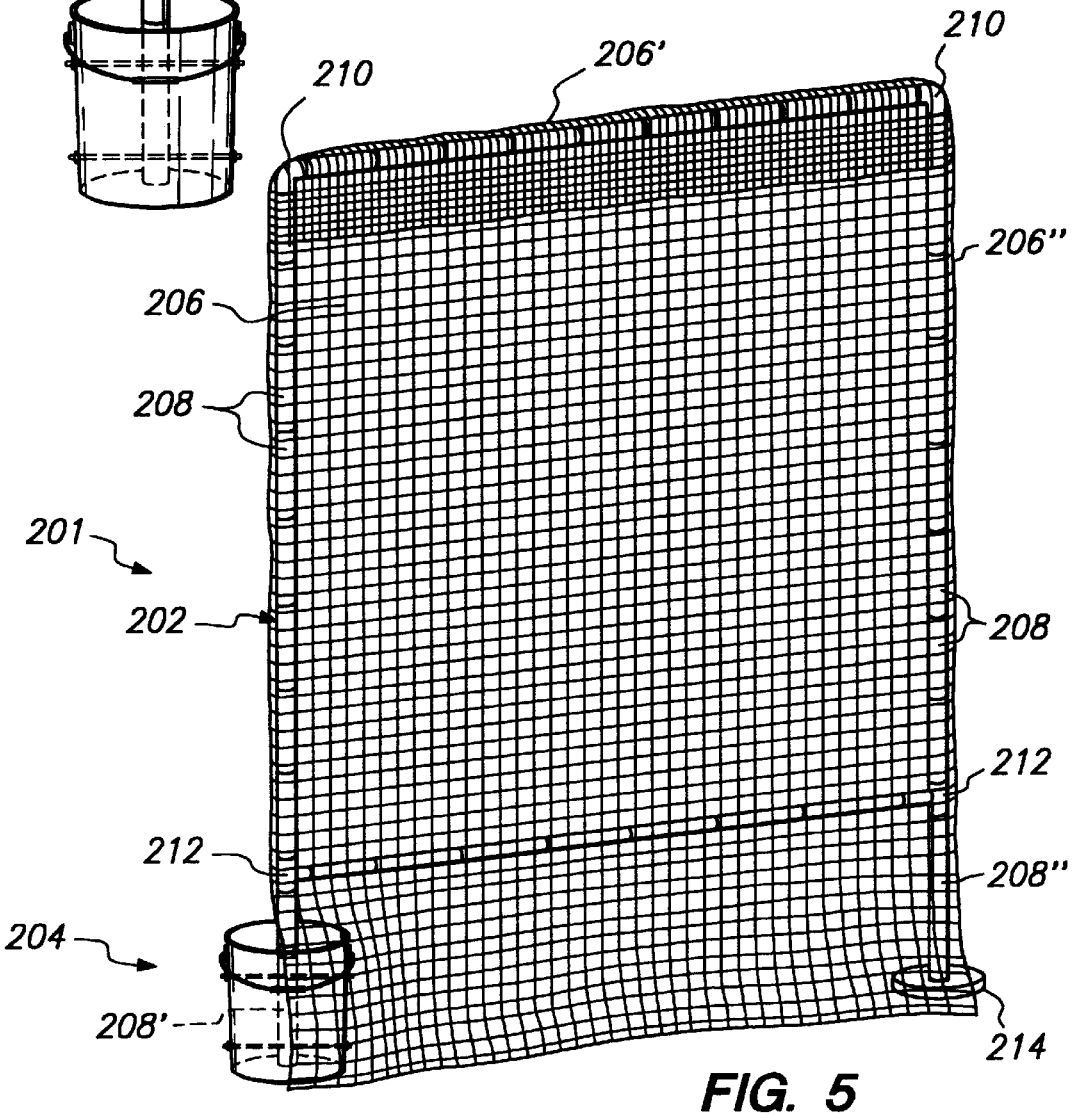
FIG. 5 is a front elevational view of a batting practice net according to a second preferred embodiment of the invention.

Referring to FIG. 5, there is shown a collapsible ball net device according to the preferred embodiment of the invention. The batting practice device 201 includes a support frame means 202, a base means 204, and a net 206. The support frame means 202 is preferably constructed of a plurality of straight tubular sections 208, corner sections 210 and T connector sections 212, as well as a plurality of connectors (not shown) but having the same shape as the connectors 16 of the first embodiment, the tubing sections 208 being selectively connectable together with the connectors, the corner sections 210 and the T sections 212. A lowermost tubing section 208' is fixed to a receptacle of the base means 204 such as in the first embodiment, while another section of the tubing 208" is secured to an auxiliary support base 214. Preferably the tubing section 208" is molded integrally with the auxiliary support base 214 as a unitary member, but may otherwise be secured thereto, such as by using adhesive. The overall support frame means 202 may be of any appropriate size, but applicant has found that a frame approximately 2 meters high and 1.5 meters wide is quite effective for use as part of the batting practice apparatus according to the invention. Using tubing sections 208, 208', 208", 210, 212 with an outside diameter of approximately 1–2 inches, the frame means 202 may be assembled together with the base means 204 in five minutes or less from a completely disassembled state, and the assembled structure is very rigid and stable. The lower transverse section of the frame means may be omitted, although it adds desired stability and rigidity to the assembled structure.

As with the first embodiment, the frame means 202, as well as the auxiliary support base 214, may be conveniently stored and transported in the receptacle of the base means 204 when disassembled. The auxiliary support base 214 may optionally function as the lid for the receptacle of the base means 204.

The net 206 is preferably constructed as a loose member having a width slightly wider than the width of the support frame means 202 when assembled and a length somewhat longer than the height of the assembled support frame means 202, while one end of the net is folded over and sewed together to define a pocket 206' which may be easily slipped over the upper end of the support frame means 202 such that the net then hangs downwardly therefrom. The net 206 is preferably constructed of a durable polymeric material such as nylon, polyester, etc., and preferably has a reinforced edge 206". With such construction the net 206 as supported from the upper end of the support frame means 202 functions very effectively for stopping lightweight balls constructed of hollow plastic or foam which have been batted after being delivered by the apparatus 1 of FIG. 1 or the modified apparatus 101 of FIG. 4.

Optionally, the apparatus of FIG. 5 may include additional means for securing lower portions of the net 206 to the support frame means 202, such as fabric strips with hook-and-loop fasteners on the ends thereof which would be fastened around a section of tubing 208 and the reinforced edge 206" of the net, or hook members projecting from the tubular sections 208 or 212 for engaging the reinforced edge 206" of the net. Also optionally, means are provided at the upper end of the support frame means 202 for causing the upper end of the net (corresponding to the pocket 206') to project away from the support frame means 202 (project from the plane of the paper) such that the upper end of the net forms a projecting ledge which effectively restricts upward movement of the ball against the net 206. Such means may comprise tubular members (not shown) extending from the corner sections 210 of the support frame means 202 out of the plane of the paper in FIG. 5.

Although there have been described what are at present considered to be the preferred embodiments of the invention, it will be understood that the invention may be embodied in other specific forms and that various changes may be made thereto without departing from the spirit or essential characteristics thereof. For example, although it is preferred that the batting practice apparatus according to the invention be constructed primarily of rigid plastic tubing sections which may be added and removed and rotated relative to each other, and without mechanical devices tending to make the device more complex and potentially less reliable, such mechanical devices may be incorporated into the batting practice apparatus according to the invention. For example, a ball release mechanism such as disclosed in U.S. Pat. No. 5,066,011 could be incorporated into the ball delivery means according to the invention, a mechanism for locking the connector section 10 into a plurality of specific angular orientations relative to the upper tubular section 14" or for locking portions of the intermediate portion 112 into specific angular orientations relative to each other could be incorporated into the batting practice apparatus according to the invention. Further, although the tubing sections are preferably round in cross section and rigid, other cross sectional shapes as well as flexible materials could be used. Still further, although portions of the ball delivery means 2, 102 according to the invention include only a single open channel member and one or more hollow tubular members as described above, it is possible to include a plurality of the open channel members in the ball delivery means.

Still further, the elongate column could be formed of two or more telescoping sections, rather than of the interfitting sections 14, 14', 14" and connectors 16.

The described embodiments are, therefore, to be considered in all aspects as illustrative and not restrictive. The scope of the invention is indicated by the appended claims rather than by the foregoing description.

I claim:

1. Batting practice apparatus comprising:

inclined ball delivery means for delivering a ball to a hitting area;

support stand means for supporting said inclined ball delivery means at an elevated position, said support stand means including a base and an elongate column connecting said inclined ball delivery means and said base;

said inclined ball delivery means and said elongate column being selectively collapsible and storable within said base;

said inclined ball delivery means including a ball feed section, a ball output section disposed at a lower level than said ball feed section, and a curved intermediate section connecting said ball feed and ball output sections such that free ends of said ball feed and ball output sections face in substantially the same direction; and said inclined ball delivery means is substantially U-shaped when viewed in plan.

* * * * *